US008474773B2

(12) United States Patent
Hull

(10) Patent No.: US 8,474,773 B2
(45) Date of Patent: Jul. 2, 2013

(54) STACKABLE BEVERAGE CONTAINER HOLDER

(75) Inventor: Richard Hull, Greenville, RI (US)

(73) Assignee: FunForAll, LLC, Greenville, RI (US)

( * ) Notice: Subject to any disclaimer, the term of this patent is extended or adjusted under 35 U.S.C. 154(b) by 63 days.

(21) Appl. No.: 13/065,525

(22) Filed: Mar. 24, 2011

(65) Prior Publication Data

US 2011/0233361 A1 Sep. 29, 2011

Related U.S. Application Data

(60) Provisional application No. 61/341,148, filed on Mar. 29, 2010.

(51) Int. Cl.
*A47K 1/08* (2006.01)

(52) U.S. Cl.
USPC ..... 248/311.2; 248/530; 248/545; 248/156

(58) Field of Classification Search
USPC ..... 248/311.2, 530, 545, 523, 532, 156, 248/314
See application file for complete search history.

(56) References Cited

U.S. PATENT DOCUMENTS

| | | | | |
|---|---|---|---|---|
| 3,021,101 | A * | 2/1962 | Gliebe | 248/532 |
| 3,627,394 | A * | 12/1971 | Benn et al. | 312/43 |
| 3,767,355 | A * | 10/1973 | Anderson, Jr. | 431/295 |
| 4,039,435 | A * | 8/1977 | Narva | 206/217 |
| 4,334,661 | A | 6/1982 | Pitt | |
| 4,927,118 | A * | 5/1990 | Pierorazio | 248/545 |
| 5,088,673 | A * | 2/1992 | Chandler | 248/311.2 |
| 5,713,546 | A | 2/1998 | Auspos | |
| 5,881,495 | A * | 3/1999 | Clark | 47/48.5 |
| 6,425,555 | B1 * | 7/2002 | Hedeman | 248/27.8 |
| 6,533,140 | B1 * | 3/2003 | Freeman | 220/737 |
| 6,575,417 | B1 | 6/2003 | Krommenakker | |
| 6,945,502 | B2 * | 9/2005 | Restifo | 248/146 |
| 7,469,865 | B2 * | 12/2008 | Mayorga | 248/85 |
| D587,541 | S * | 3/2009 | Klump | D7/701 |
| 7,516,931 | B2 | 4/2009 | Sarullo | |
| D643,253 | S * | 8/2011 | Cilmi | D7/620 |
| 8,215,167 | B2 * | 7/2012 | Hall | 73/426 |
| 2007/0138365 | A1 * | 6/2007 | Sarullo | 248/311.2 |

* cited by examiner

*Primary Examiner* — Anita M King

(74) *Attorney, Agent, or Firm* — Michael de Angeli

(57) ABSTRACT

The present invention includes two embodiments of stackable beverage container holders. In each, the beverage container holder comprises an upper cup-like receptacle for receiving a beverage container and one or more lower ground-penetrating members, for being inserted into sand, earth, or turf and thus retaining the product upright, supporting the beverage container. The product is intended to be molded as a single integral piece. The generally cylindrical receptacle may have a slot formed in it to allow reception of a beverage container having a handle, e.g., a coffee mug.

6 Claims, 2 Drawing Sheets

STACKABLE BEVERAGE CONTAINER HOLDER

CROSS-REFERENCE TO RELATED APPLICATION

This application claims priority from provisional application Ser. No. 61/341,148, filed Mar. 29, 2010.

FIELD OF THE INVENTION

This invention relates to beverage container holders each comprising a receptacle for receiving a beverage container and one or more ground-penetrating members. When the ground-penetrating member is pressed into sand, earth, or turf, a beverage container can be placed in the receptacle and be supported securely, clear of the ground surface and away from crawling insects and the like. The beverage container holders are stackable for convenience in storage and transport. Optionally, a small platform may be provided comprising one or more downwardly-extending hollow cylindrical members for fitting within the container-receiving receptacles of a like number of the beverage container holders, so that they support the platform. Other optional features are discussed below.

BACKGROUND OF THE INVENTION

The art teaches various devices for supporting beverage containers comprising receptacles for receiving a beverage container and one or more ground-penetrating members. See, for example, U.S. Pat. No. 7,516,931 to Sarullo, which is directed to a beverage container holder comprising an upper cup-like container-receiving portion and a lower ground-penetrating spike. Several embodiments are shown. For example, FIGS. 1-4 show an embodiment wherein the cup-like portion is detachable from a cruciform spike for compact storage. In FIGS. 5 and 6 an embodiment is shown wherein the spike is a hollow conical member, to allow stacking of the items. Finally, in FIGS. 7-10 the conical hollow spike is again shown, and the cup-like portions are removable therefrom, to allow separate stacking of the bases and cuplike members.

Krommenakker U.S. Pat. No. 6,575,417 is directed to a container holding device wherein a support structure comprising two stakes spaced from one another is threadedly secured to the container receiving device.

Auspos U.S. Pat. No. 5,713,546 claims a holder for beverage containers and other objects that includes a tray with a hole in it for receiving the beverage container. A U-shaped member is disposed below the hole for supporting the container; it is pivotally connected to the tray so that it can be folded out of the way for storage. Likewise, the Auspos tray is supported by a spike that is pivotally connected to the tray, again so it can be folded out of the way for storage.

Pitt U.S. Pat. No. 4,334,661 shows a beverage container comprising a ring that is sized to receive a beverage container mounted at one side to a ground penetrating stake with a container-supporting foot also secured to the stake, below the ring.

Clark U.S. Pat. No. 5,881,495 shows a turf stake which has tubular upper section for receiving a frame member, e.g. for a plant support, with a lateral extension to be impacted by a hammer or the like.

SUMMARY OF THE INVENTION

The present invention includes two embodiments of stackable beverage container holders. In each, the beverage container holder comprises an upper cup-like receptacle for receiving a beverage container and one or more lower ground-penetrating members, for being inserted into sand, earth, or turf and thus retaining the product upright, supporting the beverage container. The product is intended to be molded as a single integral piece. The generally cylindrical receptacle may have a slot formed in it to allow reception of a beverage container having a handle, e.g., a coffee mug.

Typically, the upper receptacle will be sized to receive a beverage container insulated by a foam sheath, and may be tapered slightly so as to allow nesting of a stack of identical products. Alternatively, a ridge extends inwardly circumferentially around the upper receptacle; when two or more of the products are stacked, the lower edge of this ridge of the upper one rests on the uppermost edge of the lower one, defining their spacing when stacked.

In a first embodiment, the lower penetrating member comprises a tapered structure that is cruciform (i.e., X-shaped) in cross-section, with the interior portions of the cruciform structure cut away to allow the lower end of the cruciform portion of an upper one of the products to rest within the lower section of a lower one of the products when stacked. The tapered structure may have straight outer edges to allow the structure to be received and retained within a tubular member, e.g., a fishing-rod holder on a boat.

In a second embodiment, the cruciform spike is replaced by four straight legs. Stackability is provided by provision of "negative spaces" that are effectively cutouts in the bottom of the container-receiving receptacle.

Optionally, a platform having one or more downwardly-extending legs fitting within the beverage container receptacles of a like number of beverage container holders may be provided, so as to be supported clear of the ground.

BRIEF DESCRIPTION OF THE DRAWINGS

The invention will be better understood if reference is made to the accompanying drawings, in which:

FIGS. 1-3 relate to a first embodiment of the invention, in which FIG. 1 is a perspective view of a single beverage container holder, FIG. 2 is a perspective, partly-cut-away view, showing how plural holders are stackable, and FIG. 3 is a top view;

FIGS. 4-6 relate to a second embodiment of the invention, in which FIG. 4 is a plan view, FIG. 5 an elevation, and FIG. 6 a detail;

DETAILED DESCRIPTION OF THE PREFERRED EMBODIMENTS

Figure 1:
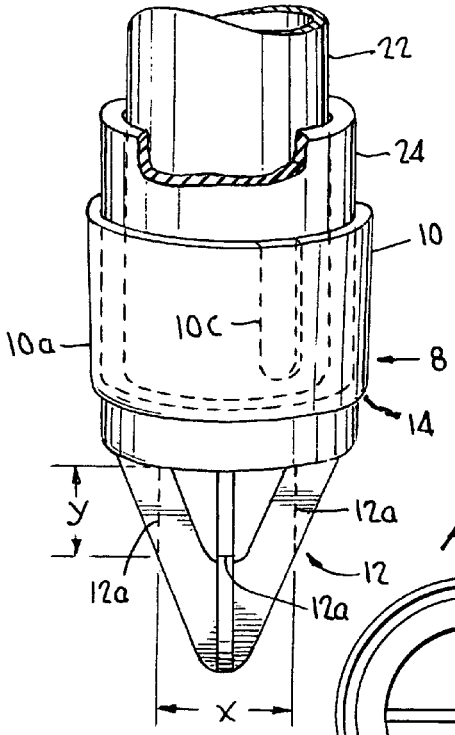
Figure 2:
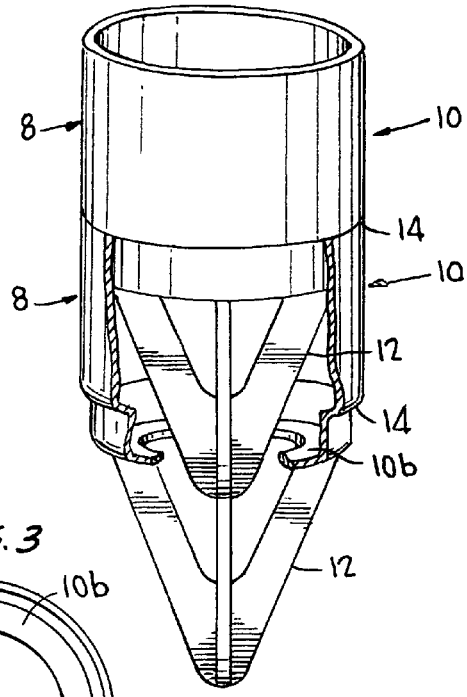
Figure 3:
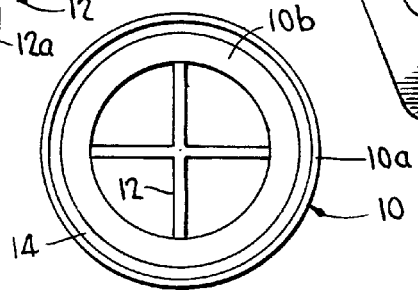

As mentioned, FIGS. 1-3 relate to a first embodiment of the beverage container holders of the invention. In this embodiment, the beverage container holder 8 comprises an upper receptacle 10, comprising a generally hollow cylindrical portion 10*a* and an inwardly-extending flange 10*b*, for receiving and supporting a beverage container 22 and a lower ground-penetrating member 12, for being inserted into sand, earth, or turf and thus retaining the product upright, supporting the beverage container. The product is intended to be molded as a single integral piece. As indicated by dashed lines at 10*c*, the generally hollow cylindrical portion 10*a* may be partially cut away so as to form an open-ended slot, for receiving the handle of a beverage container having a handle, such as a coffee cup.

Typically upper receptacle 10 will be sized to receive a beverage container 22 insulated by a foam sheath 24, and may be tapered slightly in order to allow stacking a number of identical products. In the embodiment shown, a ridge 14 extends inwardly circumferentially around the upper receptacle 10. Accordingly, when two or more of the products 8 are stacked for storage or transport, the lower edge of ridge 14 of the upper one rests on the uppermost edge of the receptacle 10 of the lower product 8, defining their spacing when stacked. See FIG. 2.

The lower penetrating member 12 comprises a tapered structure that is cruciform (i.e., X-shaped) in cross-section, as shown by FIG. 3. The interior portions of the cruciform structure are cut away to allow the lower end of the cruciform portion 12 of an upper one of the products 8 to rest within the lower section of a lower one of the products 8 when stacked, as shown in FIG. 2. As shown by dashed lines at 12*a*, the outer edges of the cruciform structure 12 may be cut away so as to define a straight-edged portion of diameter X and length Y, whereby the cruciform structure can be received and retained in a tubular member of like inner diameter, such as a fishing-rod holder on a boat.

Figure 4:
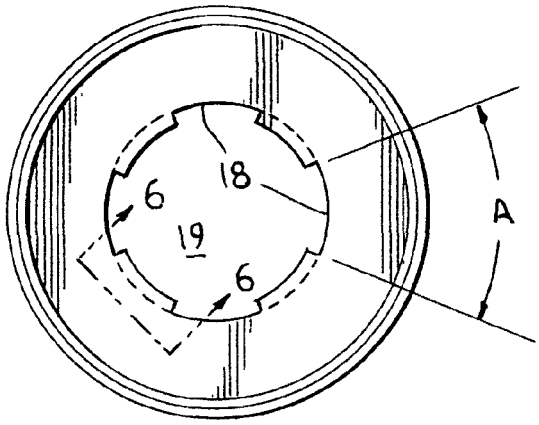
Figure 5:
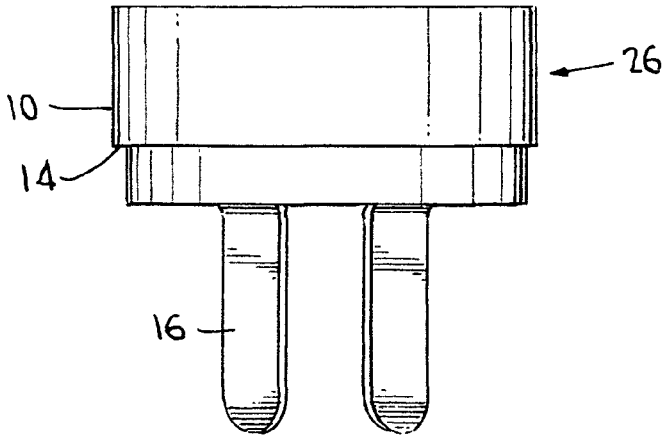
Figure 6:
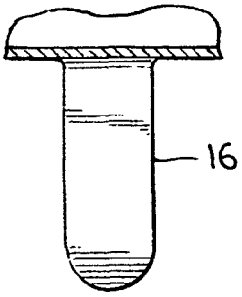

FIGS. 4-6 relate to a second embodiment of the invention, in which the beverage container holder 26 again comprises an upper container—receiving receptacle 10 having an inwardly-extending ridge 14 defining the spacing of the holders 26 when stacked. The cruciform penetration member 12 of the first embodiment is replaced by a plurality of legs 16 (four being shown in the drawings). Identical products are rendered conveniently stackable by ensuring that the legs 16 are spaced equally around the centerline of the product, and by provision of "negative spaces" 18 that are at least as wide as the legs 16, and also spaced regularly. See FIG. 4. In this way the legs 16 of an upper one of the products can fit readily within the negative spaces 18 of a lower one. For example, if four legs 16 are provided as shown the negative spaces can extend over 45° (indicated as angle A in FIG. 4) of the circumference of an open orifice 19 in the bottom of the receptacle; the legs would be slightly less wide, so as to ensure easy interfitting of nested beverage holders 26.

Figure 7:
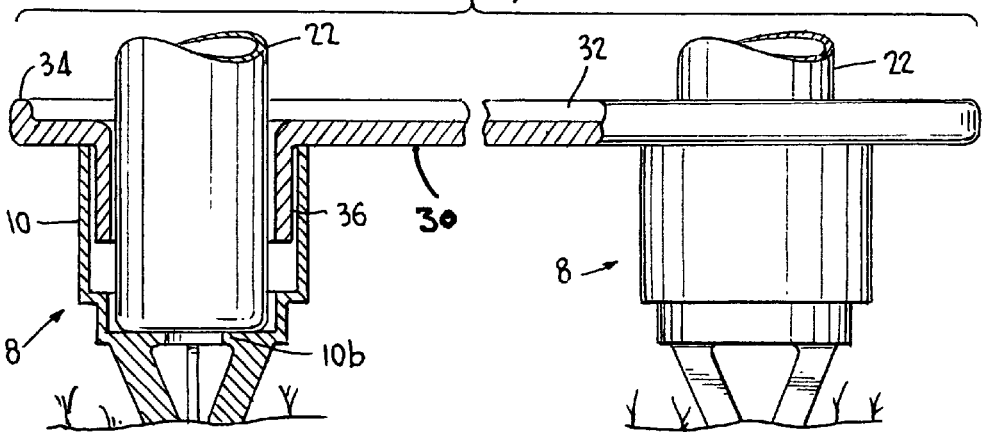
FIG. 7 shows an optional platform that can be supported by one or more of the holders, in either embodiment, in partial cross-section.

FIG. 7 shows an optional platform that can be supported off the ground by one or more of the beverage container holders of the invention, those of FIGS. 1-3 being shown in FIG. 7. Typically, and as shown by the partial cross-section at the left side of FIG. 7, the platform 30 will be molded as a single integral member, and comprises a generally planar member 32 that might be, for example, round, elliptical, or rectangular, and possibly provided with a peripheral lip 34. Platform 30 also comprises one or more (two being shown) downwardly-extending hollow cylindrical members 36 fitting within the receptacles 10 of a like number of beverage container holders 8. Beverage containers 22 can be received within these hollow cylindrical members and be supported by the receptacles 10, and if not too great in diameter, may be provided with insulated sleeves.

Thus, in use, the lower penetrating member of the beverage container holder of the invention is simply forced into the ground, so that the beverage container holder serves to support a beverage container in its receptacle 10. If it is desired to employ platform 30, its cylindrical members 36 are received by the receptacles of the beverage container holder, as illustrated by FIG. 7.

Figure 8:
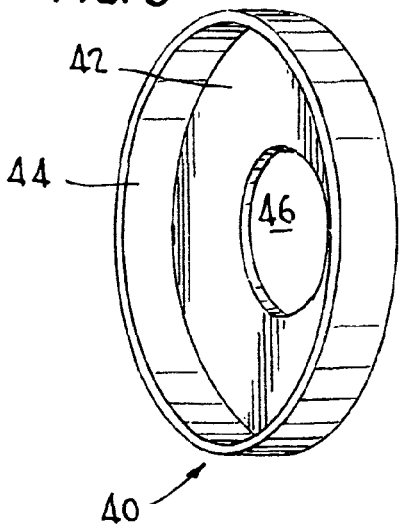
FIG. 8 shows a snap-on cap useful when a bottle smaller in diameter than the beverage container is to be received.

Finally, FIG. 8 shows an optional cap member 40 for fitting over the upper end of one of the beverage container holders of the invention, e.g., 10 of FIG. 1-3 and 7, or 26 of FIGS. 4-6. The cap 40 comprises a flat upper member 42 and a downwardly-extending lip 44, sized so that the cap 40 is a good fit over the beverage container holder 10 or 26. A central orifice 46 is provided, sized to receive the neck of a typical beverage bottle. In this way both cans (as shown in the other Figures) and bottles can be securely received by the beverage container holder of the invention.

What is claimed is:

1. A stackable beverage container holder, comprising:

a generally tubular upper cup-like receptacle having an open upper end for receiving a beverage container, said cup-like receptacle being formed to define a first ridge extending inwardly circumferentially from the wall of said cup-like receptacle, a further tubular section depending from the inner edge of said first ridge, and a flange extending inwardly circumferentially from a lower edge of said further tubular section, for receiving and supporting a beverage container, and having a central aperture therein, and a ground-penetrating member formed integrally with and extending downwardly from said cup-like receptacle, wherein when a plurality of said beverage container holders are stacked, the first ridge of an upper one of said beverage container holders rests on the open upper end of the cup-like receptacle of a lower one of said beverage container holders, and the ground-penetrating member the upper one of said beverage container holders protrudes through the aperture in the second flange of the lower one of said beverage container holders; and wherein said ground-penetrating member of said stackable beverage container holder is cruciform in cross-section and tapered in outline, with the inner portions of the cruciform ground-penetrating member being cut away, whereby when a plurality of said beverage container holders are stacked, the cruciform ground-penetrating member of an upper one of said beverage container holders fits within the cut away portion of the cruciform ground-penetrating member of the lower of the beverage container holders.

2. The stackable beverage container holder of claim 1, wherein the outer periphery of the cruciform ground-penetrating member is cut away to define parallel edges, whereby said cruciform ground-penetrating member can be received within a tubular member.

3. In combination, the stackable beverage container holder of claim 1 and a cap member comprising a planar circular member having a central aperture therein and a downwardly-depending peripheral flange, sized such that said flange is a snap-fit over the open upper end of the upper cup-like receptacle of the stackable beverage container holder.

4. The stackable beverage container holder of claim 1, wherein the tubular upper cup-like receptacle is cut away to form a slot having an open end at the upper edge of said upper cup-like receptacle, so as to allow a beverage container having a handle to be received therein.

5. A stackable beverage container holder, comprising:

a generally tubular upper cup-like receptacle having an open upper end for receiving a beverage container, said cup-like receptacle being formed to define a first ridge extending inwardly circumferentially from the wall of said cup-like receptacle, a further tubular section depending from the inner edge of said first ridge, and a flange extending inwardly circumferentially from a lower edge of said further tubular section, for receiving and supporting a beverage container, and having a central aperture therein, and a ground-penetrating member formed integrally with and extending downwardly from said cup-like receptacle, wherein when a plurality of said beverage container holders are stacked, the first ridge of an upper one of said beverage container holders rests on the open upper end of the cup-like receptacle of a lower one of said beverage container holders, and the ground-penetrating member the upper one of said beverage container holders protrudes through the aperture in the second flange of the lower one of said beverage container holders; and wherein said ground-penetrating member of said stackable beverage container holder comprises a plurality of legs extending perpendicular to said flange, and wherein the inner edge of said flange is cut away to provide negative spaces within which said legs fit when a plurality of said beverage container holders are stacked.

6. In combination, a stackable beverage container holder and a platform, the stackable beverage holder comprising:

a generally tubular upper cup-like receptacle having an open upper end for receiving a beverage container, said cup-like receptacle being formed to define a first ridge extending inwardly circumferentially from the wall of said cup-like receptacle, a further tubular section depending from the inner edge of said first ridge, and a flange extending inwardly circumferentially from a lower edge of said further tubular section, for receiving and supporting a beverage container, and having a central aperture therein, and a ground-penetrating member formed integrally with and extending downwardly from said cup-like receptacle, wherein when a plurality of said beverage container holders are stacked, the first ridge of an upper one of said beverage container holders rests on the open upper end of the cup-like receptacle of a lower one of said beverage container holders, and the ground-penetrating member the upper one of said beverage container holders protrudes through the aperture in the second flange of the lower one of said beverage container holders; and said platform comprising a generally planar surface and one or more downwardly-depending cylindrical members adapted to be received within the cup-like receptacles of one or more of said stackable beverage container holders.

* * * * *